US005469728A

United States Patent [19]

Caporusso et al.

[11] Patent Number: 5,469,728

[45] **Date of Patent: * Nov. 28, 1995**

[54] SHAPED GROOVE COUNTERMATRIX FOR ROTARY GROOVE PULLEY MATRIX AND COUNTERMATRIX BENDING HEAD PIPE BENDING MACHINES

[76] Inventors: Alessandro Caporusso; Mario Caporusso, both of Via Pantanelle, 21, Piedimonte San Germano, Frosinone, Italy

[ * ] Notice: The portion of the term of this patent subsequent to Sep. 13, 2011, has been disclaimed.

[21] Appl. No.: 304,705

[22] Filed: Sep. 12, 1994

Related U.S. Application Data

[62] Division of Ser. No. 29,063, Mar. 10, 1993, Pat. No. 5,345,802.

[30] Foreign Application Priority Data

Mar. 12, 1992 [IT] Italy ..... RM92U0064

[51] Int. Cl.[6] ..... B21D 7/04

[52] U.S. Cl. ..... 72/154; 72/159; 72/41; 72/44

[58] Field of Search ..... 72/154, 159, 149, 72/43, 41, 44, 217, 364, 307, 388

[56] References Cited

U.S. PATENT DOCUMENTS

| | | | |
|---|---|---|---|
| 4,130,004 | 12/1978 | Eaton | 72/154 |
| 4,355,528 | 10/1982 | Rotenberger | 72/388 |
| 4,765,168 | 8/1988 | Stange et al. | 72/159 |
| 4,959,984 | 10/1990 | Trudell et al. | 72/20 |
| 5,127,248 | 7/1992 | Sanseau et al. | 72/149 |
| 5,345,802 | 9/1994 | Caporusso et al. | 72/154 |

FOREIGN PATENT DOCUMENTS

| | | |
|---|---|---|
| 530611 | 8/1954 | Belgium . |
| 2501545 | 9/1982 | France . |
| 1917926 | 4/1968 | Germany . |
| 1752210 | 5/1971 | Germany . |
| 792999 | 4/1958 | United Kingdom . |

*Primary Examiner*—David Jones
*Attorney, Agent, or Firm*—Young & Thompson

[57] ABSTRACT

A shaped groove countermatrix for a rotary groove pulley matrix and countermatrix head pipe bending machines has a semicircular cross-sectional tract and an end tract (2) tapered, both longitudinally and transversely according to substantially elliptic profiles (20). With respect to the preceding tract, an edge of a groove (10) remains at the same level. The end tract (2) has its cross section substantially determined by the arcs (4, 4') of two ellipses (12) with their major axes (6, 6') parallel to and slightly offset with respect to a plane of longitudinal symmetry (8) of the groove (10) which is inferiorly radiused by an arc which is elliptic too. The tapering of the end tract (2), starting from a substantially parabolic profile (14), has its axis on the plane of longitudinal symmetry (8) of the groove (10) and its convexity (16) at a short distance from the exit edge (18) of the groove (10). A well (22) has a plug (22') which allows for feeding a lubricating fluid vein onto the groove (10) which is in fluid communication through a hole (24) via a wick (24'). A check valve (26) allows recharge of the well (22) with the lubricating fluid.

5 Claims, 1 Drawing Sheet

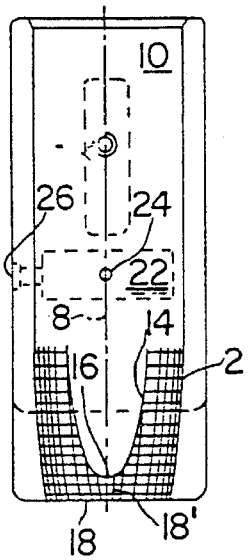
FIG.1
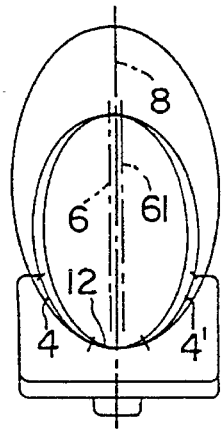
FIG.2
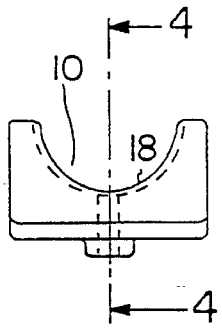
FIG.3
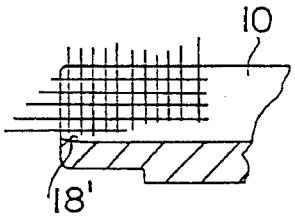
FIG.4
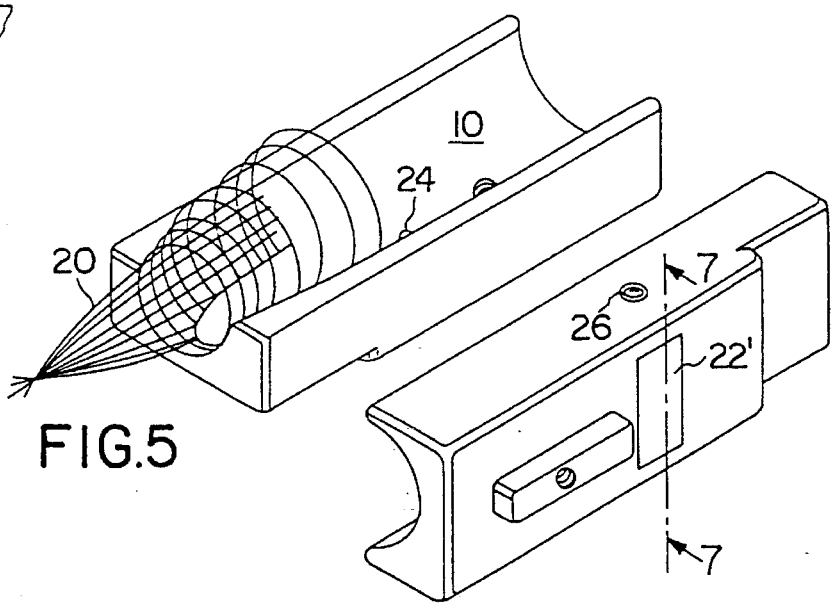
FIG.5
FIG.6
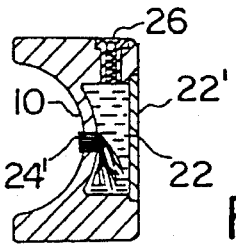
FIG.7

SHAPED GROOVE COUNTERMATRIX FOR ROTARY GROOVE PULLEY MATRIX AND COUNTERMATRIX BENDING HEAD PIPE BENDING MACHINES

This application is a division of application Ser. No. 08/029,063, filed Mar. 10, 1993, now U.S. Pat. No. 5,345,802.

BACKGROUND OF THE INVENTION

The present invention relates to a shaped groove countermatrix for rotary groove pulley matrix and countermatrix bending head pipe bending machines.

The operating principle of such machines is to stress a pipe to be bent to bending arranging the latter between the grooves of the matrix and of the countermatrix and making the pulley matrix to rotate on its axis, which pulley matrix is assembled on a driving shaft and drags the pipe along a bending path by friction in its groove.

In order to reduce the ovalization as much as possible and to avoid wrinklings and breakings of the pipe during the bending operation, countermatrices are used in the art that have grooves shaped according to suitable geometries, as is exemplified in Italian Patents No. 1.147.601 and No. 1.172.068, granted to the same Applicant of the present application.

Moreover, in most cases one proceeds to the lubrication of the contact between the pipe and the countermatrix, to avoid seizures during the bending operation. This lubrication must, for instance, be carried out necessarily for aluminum pipes and for pipes with a sheath in plastic. The lubricant is sprayed or applied with a brush.

The shaped groove of prior art that better achieves its end has been suggested by the same applicant of the present invention, and has a semicircular cross section except in an end tract, which is the exit in the sense of feed of the pipe during the bending operation. Such an end tract is tapered both longitudinally and transversely towards the exit edge, starting from a semicircular cross section of the groove itself, and has its cross section made up of two ellipses with their major axes parallel to and slightly offset from the plane of longitudinal simmetry of the groove, which ellipses are equal to each other and inferiorly radiused by a tract which is elliptic too.

However, such a countermatrix has the problem that the pipes bent utilizing it show a visible circular tapering at the ends of the bending tracts.

As regards the lubrication of the preceding countermatrices to prepare them to the bending operation, it has the shortcoming of being difficult and of consuming time.

SUMMARY OF THE INVENTION

The object of the present invention is to provide a shaped countermatrix that doesn't have the shortcoming of giving rise to a visible circular tapering in the bent pipe.

Another object of the present invention is to provide a countermatrix that doesn't have to be lubricated by an operator, but that is, on the contrary, self-lubricated.

Therefore, the present invention relates to a shaped groove for a groove pulley rotary bending head and countermatrix pipe bending machine, having an end tract in the sense of feed of a pipe, which end tract is tapered both longitudinally and transversely, according to substantially elliptic profiles, with a cross section substantially determined by the arc, included between the edges of the preceding semicircular cross section tract, of the curve made up of two ellipses with their major axes parallel to and slightly offset from the plane of longitudinal simmetry of the groove, which ellipses are equal to each other and radiused by tracts which are elliptic too, the tapering starting from the preceding semicircular cross section tract according to a substantially parabolic profile, with its simmetry axis on the longitudinal simmetry plane of the groove, and its convexity turned towards the exit edge of the groove and arranged at a short distance from the same.

According to another aspect, the present invention relates to a shaped groove countermatrix for a groove pulley rotary bending head and countermatrix pipe bending machine, which comprises means for feeding lubricating fluid in fluid communication with the surface of the groove through a hole and wick means inserted in the latter.

The countermatrix of the present invention has the aesthetic advantage of extending, by virtue of its geometry, the collar tapering which was had in prior art along a substantially parabolic profile outstretched into the bending tract of the pipe, rendering it substantially unvisible at first sight.

Another advantage is relevant to the fact that by virtue of its self-lubricated construction, it doesn't impose the operator a lubricant application downtime.

BRIEF DESCRIPTION OF THE DRAWING

The present invention will be best understood on the basis of the following detailed disclosure of its preferred embodiment, given only as a matter of example and not of restriction, considered with reference to the annexed drawings, wherein:

FIG. 1 is a top view of the countermatrix of the present invention;

FIG. 2 is the view of a cross section thereof;

FIG. 3 is a front view;

FIG. 4 is a section view according to line A—A in FIG. 3;

FIG. 5 is a perspective view;

FIG. 6 is a rear perspective view, and

FIG. 7 is a section view according to line A—A in FIG. 6.

DETAILED DESCRIPTION OF THE PREFERRED EMBODIMENTS

As can be observed in FIG. 1, the shaped groove countermatrix of the present invention has a semicircular section except in an end tract 2, put into evidence by a network of lines in the figure. Such a tract, as can be observed from FIGS. 3, 4 and 5, is tapered both in the transversal and in the longitudinal sense, according to substantially elliptic profiles. The cross section is constructed as is represented in FIG. 2. It is made up of two arcs 4, 4' of equal ellipses, with their major axes 6, 6' parallel to and slightly offset with respect to the plane of longitudinal simmetry 8 of the groove 10, which arcs are inferiorly radiused to each other by an arc of ellipse 12. The above mentioned tapering starts not from a cross section of the groove 10, but from a parabolic profile 14 depicted in FIG. 1.

The portion of the groove that actively works upon the pipe during the bending is only the end tract 2 with its novel geometry, which spreads the tapering on the pipe onto the parabolic profile 2, rendering the tapering substantially not visible at first sight. The parabolic profile has its axis on the plane of longitudinal simmetry 8 of the groove 10, and pushes as far as in proximity 16 of the exit edge 18 of the groove 10. It is worthy to be pointed out the short tract 18' between the parabola and the exit section 18 of the groove 10, with a rise which is visible in FIG. 4.

FIG. 5 puts the elliptic profiles 20 according to which the tract 2 is tapered into evidence.

As represented in FIGS. 6 and 7, the countermatrix of the present invention is endowed with a well 22 for collecting the lubricating oil, closed by a plug 22', in fluid communication with the groove 10 through a hole 24 (see FIG. 5) through which the well feeds an oil veil by means of a wick 24'. A spring loaded ball check valve 26 of commercial type is provided to recharge the well 22.

The present invention has been disclosed with reference to a preferred embodiment thereof, but it is to be understood that changes and/or additions can be made thereto, without so departing from the scope of protection defined by the appended claims.

For example, the lubricating veil feed could also come from a spigot arranged on the exterior of the countermatrix, instead of being directly incorporated thereto.

We claim:

1. A countermatrix for a pipe bending machine, the countermatrix comprising an elongated body having an elongated groove therein, the elongated body having a longitudinal axis, and the groove having arcuate cross sections in planes parallel to each other and perpendicular to said axis that decrease in radius of curvature toward one end of said elongated body.

2. A countermatrix as claimed in claim 1, said groove having circular cross-sectional configurations in planes perpendicular to said axis and parallel to each other, said circular cross-sectional configurations being of constant radius of curvature toward the other end of said elongated body.

3. A countermatrix for a pipe bending machine, comprising an elongated body having an elongated groove extending longitudinally thereof, said groove having a longitudinal axis, said groove having side walls having radii of curvature, said radii of curvature decreasing in a direction toward one end of said elongated body more rapidly than along a central portion of said body midway between the ends of said body.

4. A countermatrix as claimed in claim 3, the rate of decrease of said radii increasing in said direction upon progressively approaching said one end of said elongated body, whereby cross sections of the side walls of said groove in planes parallel to said axis are concave.

5. A countermatrix as claimed in claim 3, the rate of change of said radii from said central portion of said body toward the other end of said matrix being zero.

* * * * *